US008206165B2

(12) United States Patent
Mito

(10) Patent No.: US 8,206,165 B2
(45) Date of Patent: Jun. 26, 2012

(54) ELECTRICAL CONNECTOR ASSEMBLY

(75) Inventor: Yusuke Mito, Aichi (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 13/107,273

(22) Filed: May 13, 2011

(65) Prior Publication Data

US 2011/0217865 A1 Sep. 8, 2011

Related U.S. Application Data

(63) Continuation of application No. PCT/JP2009/005837, filed on Nov. 4, 2009.

(30) Foreign Application Priority Data

Nov. 13, 2008 (JP) ..... 2008-290680

(51) Int. Cl.
*H01R 13/62* (2006.01)

(52) U.S. Cl. ..... 439/157

(58) Field of Classification Search ..... 439/328, 439/157, 488–489, 372, 152–153, 347
See application file for complete search history.

(56) References Cited

U.S. PATENT DOCUMENTS

| | | | | |
|---|---|---|---|---|
| 6,019,620 | A | 2/2000 | Kodama et al. | |
| 6,309,232 | B1 * | 10/2001 | Okabe et al. | 439/157 |
| 6,345,995 | B1 * | 2/2002 | Bigotto et al. | 439/157 |
| 6,352,440 | B1 * | 3/2002 | Okabe et al. | 439/157 |
| 6,619,978 | B2 * | 9/2003 | Okabe et al. | 439/372 |
| 6,705,882 | B2 | 3/2004 | Casses | |
| 7,070,438 | B2 * | 7/2006 | Dillon | 439/347 |
| 7,255,581 | B2 * | 8/2007 | Yamaoka | 439/157 |
| 7,481,661 | B2 * | 1/2009 | Takahashi et al. | 439/157 |
| 7,513,783 | B2 * | 4/2009 | Okuda et al. | 439/157 |

FOREIGN PATENT DOCUMENTS

| | | |
|---|---|---|
| JP | 11-260484 | 9/1999 |
| JP | 2007-188663 | 7/2007 |

OTHER PUBLICATIONS

International Search Report cited in co-pending International Application No. PCT/JP2009/005837, dated Dec. 8, 2009, 2 pages.

* cited by examiner

*Primary Examiner* — Jean F Duverne
(74) *Attorney, Agent, or Firm* — Barley Snyder

(57) ABSTRACT

An electrical connector assembly is configured so that a plug can be connected to or disconnected from a receptacle easily and reliably. Levers (40A, 40C) of plug (30A, 30C) out of three plug (30A, 30B, 30C), the plug (30A, 30C) being connected to hoods (26A, 26C) on both end sides of a receptacle (20), each have a length such as to project to outward from the hoods (26A, 26C), and the levers (40A, 40C) are configured so as to be locked to a receptacle (21) on the outside of the hoods (26A, 26C).

5 Claims, 5 Drawing Sheets

30A, 30C
40A, 40C
70
31
75
75

40b
47
40A, 40C
30A, 30C
40a
57
49
70
48
46
41
31
31a
55

40A, 40C
58
57a
57
60
59
31a
30A, 30C
31

30A, 30C
55
46
31a
32
47
72
70
40A, 40C
31
47
31a
46
55

ELECTRICAL CONNECTOR ASSEMBLY

CROSS-REFERENCE TO RELATED APPLICATIONS

This application is a continuation of PCT International Application No.: PCT/JP2009/005837 filed Nov. 4, 2009, which claims priority under 35 U.S.C. §119 to Japanese Patent Application No.: 2008-290680, filed Nov. 13, 2008.

FIELD OF THE INVENTION

The present invention relates to an electrical connector assembly having a plug connector and a receptacle connector.

BACKGROUND

Electrical connectors (hereinafter, referred simply to as connector(s)) mounted on a circuit board (hereinafter, referred simply to as a board) such as a printed wiring board to connect the board to any other electrical circuit are generally known. These connectors include, as principal constituent elements, contacts and a housing for holding the contacts. Forming the connector, are generally, a female receptacle and a male plug. The receptacle has a tubular hood, and a plurality of contacts are arranged in this hood. The plug has a housing inserted into the hood, and this housing is provided with contacts that mate with the contacts of the receptacle connector.

To reduce the mating force for inserting the plug into the receptacle, a lever has been provided as shown in Japanese Unexamined Patent Application Publication No. 2007-188663. The connector with a lever is provided so that the lever is rotatable with respect to the plug connector. By turning the end of the lever, a multiplying force draws the receptacle and plug toward each other and likewise separates them. By this multiplying force, the plug can be inserted into or pulled out of the receptacle by a smaller force applied to the lever.

Unfortunately, such conventional connector lever assemblies have a problem in that lever motion is often fouled by the wiring terminated in the plug, especially in situations where the wiring enters the plug at a right angle.

Also, it is common practice that after the plug has been mated with the receptacle by the multiplying force exerted by the pushing-down of the lever, a part of the lever is locked to the receptacle. In this case, when the plug is again removed from the receptacle after mating, right angle becomes a hindrance, and it sometimes becomes difficult to unlock the lever. Also, during shipping the wires may get caught or tangled between the lever and plug housing casing damage to the wire either in transit or afterwards in attempts to untangle them from the lever.

SUMMARY

It is an object of the invention, among other objects to provide an electrical connector assembly that can be connected or disconnected from a receptacle connector easily and reliably. The invention provides an electrical connector assembly comprising a first housing; a second housing mating with the first housing; a first contact held in the first housing; and a second contact held in the second housing and connected to the first contact, wherein the first housing comprises a hood forming a space for receiving the second housing; the second housing comprises a lever provided on the second housing so as to be rotatable via a support shaft to reduce a force for inserting the second housing into the hood; and the lever extends in a longitudinal direction of the second housing, and is formed so as to extend to an outside of the hood in a state in which the second housing is inserted into the hood of the first housing, and a locking part for locking the lever to the first housing in a direction intersecting substantially at right angles with a direction in which the second housing is inserted into or pulled out of the first housing in the outside portion of the hood is provided.

BRIEF DESCRIPTION OF DRAWINGS

The invention will now be described by way of example with reference to the following figures of which.

DETAILED DESCRIPTION OF THE EMBODIMENTS

Figure 1A:
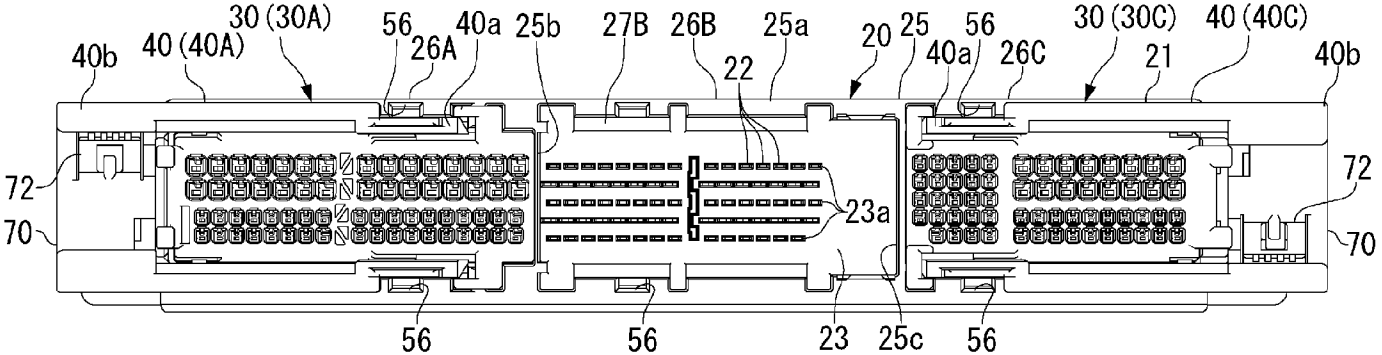
FIG. 1A is a plan view of an electrical connector assembly in accordance with an embodiment of the present invention.

The present invention will now be described in detail based on an embodiment shown in the accompanying drawings.

As shown in FIGS. 1A, 1B, 2A and 2B, an electrical connector assembly 10 comprises a receptacle 20 fixed to the printed wiring board side and a plug 30 capable of being mated with the receptacle 20.

In this embodiment, for example, three plugs 30A, 30B and 30C are each mated with receptacle 20 in the same direction. It should be understood that the number of plugs 30 mated with the receptacle 20 may vary. For example, the number of plugs 30 can be only one, two, three, four or more.

The receptacle 20 comprises a first housing 21 made of a resin and a plurality of first contacts 22 each formed of a conductive material such as a copper based or other suitable conductive material.

The first housing 21 has a contact holding wall 23 for holding the contacts 22 in a space. As shown in FIG. 1B, the first housing 21 is attached to a unit housing 100 such as an electrical equipment unit such that an inner side of the contact holding wall 23 is inserted into the unit housing 100, an outer side of the contact holding wall 23 faces the outside of the unit housing 100. On the inner side of the contact holding wall 23, a cover part 24 is formed to cover the contacts 22 connected to a printed wiring board (not shown) housed in the unit housing 100. On the outer side of the contact holding wall 23, there is provided a mating part 25 with which the plugs 30A, 30B and 30C are mated. The mating part 25 is formed by a rectangular outer peripheral wall 25*a* rising from the contact holding wall 23 and partitioning walls 25*b* and 25*c* partitioning the interior of the outer peripheral wall 25*a* into three sections. Since the interior of the outer peripheral wall 25*a* is partitioned into three sections by the partitioning walls 25*b* and 25*c*, three tubular hoods 26A, 26B and 26C are formed.

The insides of the hoods 26A, 26B and 26C are adapted to receive plugs 30A, 30B and 30C in plug receiving spaces 27A, 27B and 27C.

Figure 1B:
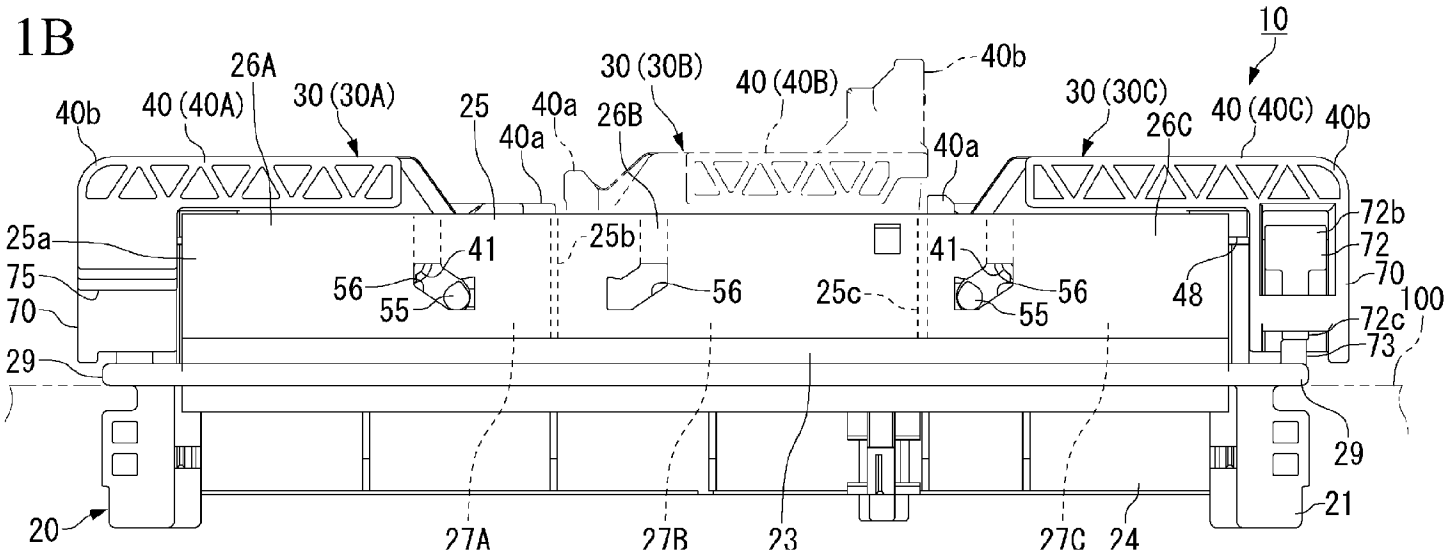
FIG. 1B is a front view thereof.

As shown in FIG. 1A, the contact holding wall 23 is formed with insertion holes 23*a* that penetrate the wall 23 for holding the contacts 22 in spaced arrangement in the hoods 26A, 26B and 26C.

As shown in FIG. 1B, the contact holding wall 23 is formed with projections 29 that are adjacent to the hoods 26A and 26C at both ends and project outward.

Figure 3:
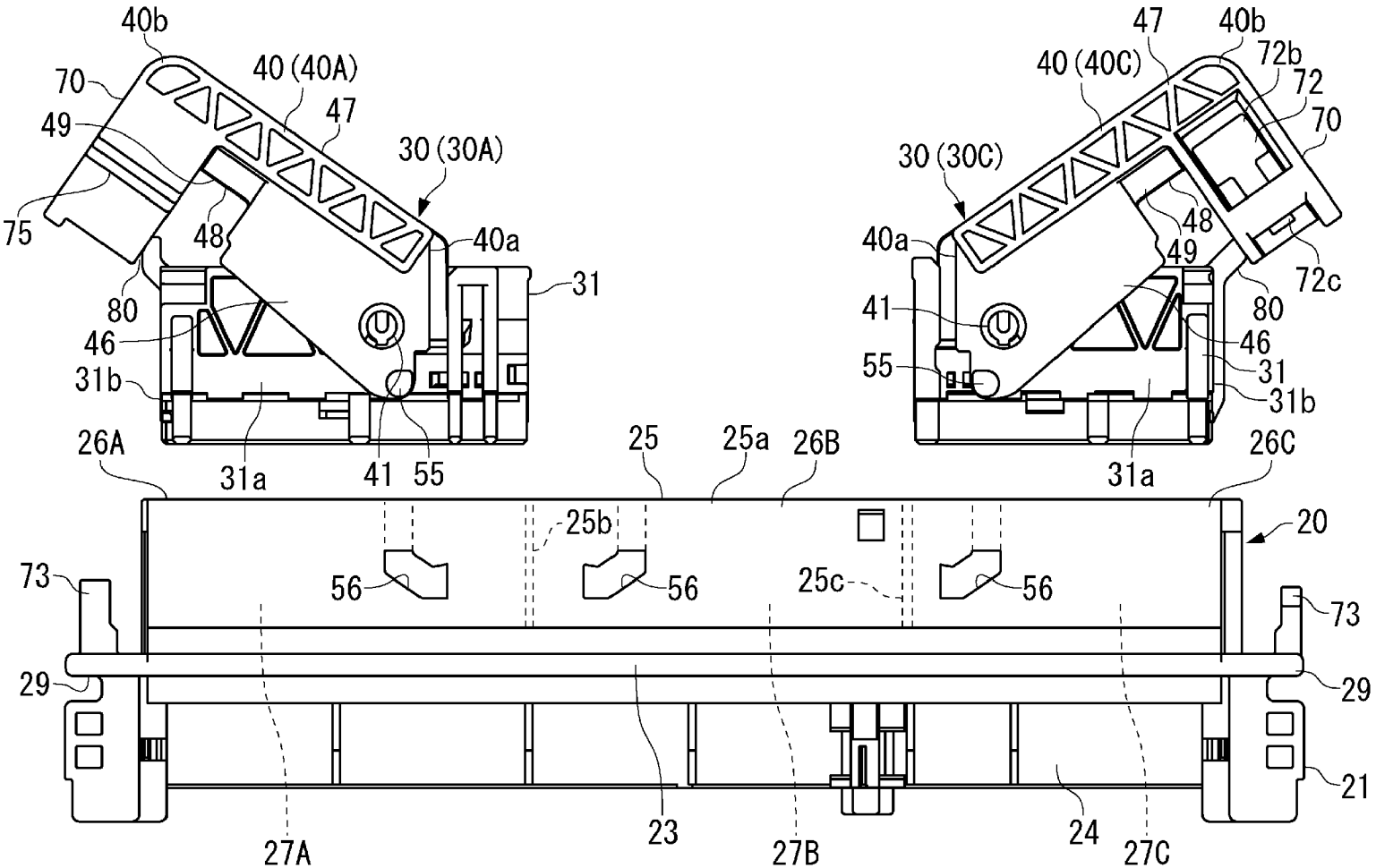
FIG. 3 is a front view showing a state in which a plug is being mated with a receptacle.

As shown in FIG. 3, each of the plugs 30A, 30B and 30C comprises a insulative second housing 31 mated with the hood 26A, 26B, 26C of the first housing 21 and a plurality of second contacts (not shown) each formed of a conductive material such as a copper alloy or other suitable conductive material. Note that in FIG. 3, only the plugs 30A and 30C are shown and plug 30B has been removed to better illustrate the first housing 21.

As shown in FIG. 4, the second housing 31 is shaped to fit into the hood 26A, 26B, 26C of the first housing 21. Corresponding to the contacts 22 of the receptacle connector 20, the plug housing 31 is formed with a plurality of contact holding holes 32 arranged in a spaced relationship. Each of the contact holding holes 32 holds a contact which is not shown.

Into the contact holding holes 32 that are open to the upper surface side of the second housing 31, electric wires (not shown) are inserted and electrically connected to a respective contact.

The plug 30A, 30B, 30C having the above-described configuration is mated with the receptacle 20 by inserting the plug 31 into the hood 26A, 26B, 26C of the receptacle 21. Thereby, the contacts on the plug 30A, 30B, 30C are electrically connected to the contacts 22 located in the hood 26A, 26B, 26C of the first housing 21.

As shown in FIG. 1, to reduce the force necessary when the second housing 31 is inserted into or pulled out of the first housing 21, the second housing 31 is provided with a lever 40 having and end 40*a* thereof which is rotatable. When the second housing 31 is inserted into or pulled out of the first housing 21, the lever 40 is rotated.

Also, the lever 40 locks the second housing 31 to the first housing 21. In order to lock the second housing 31 to the first housing 21, the end 40*b* of the lever 40 is rotatably urged toward the first housing 21.

Figure 2A:
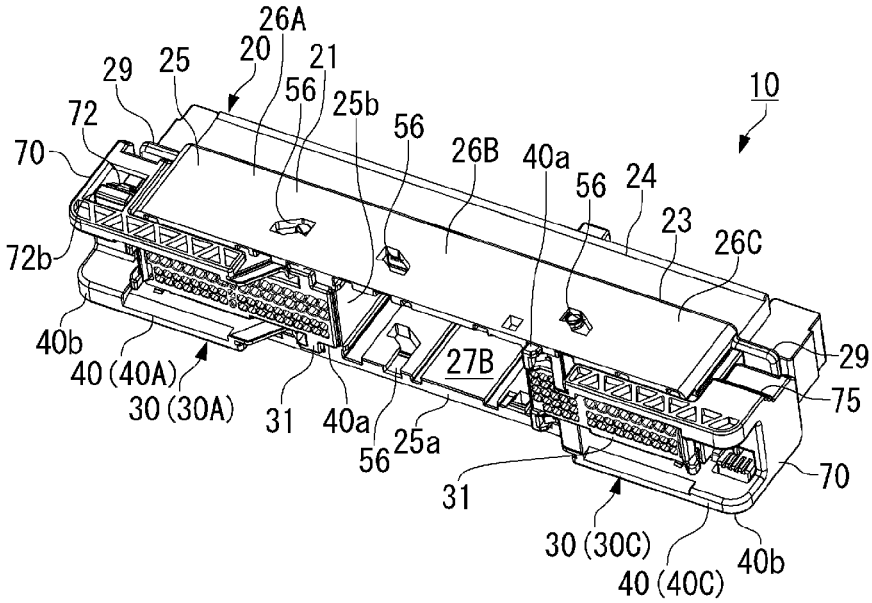
FIG. 2A is a perspective view of the electrical connector assembly as viewed from the plug side.
Figure 2B:
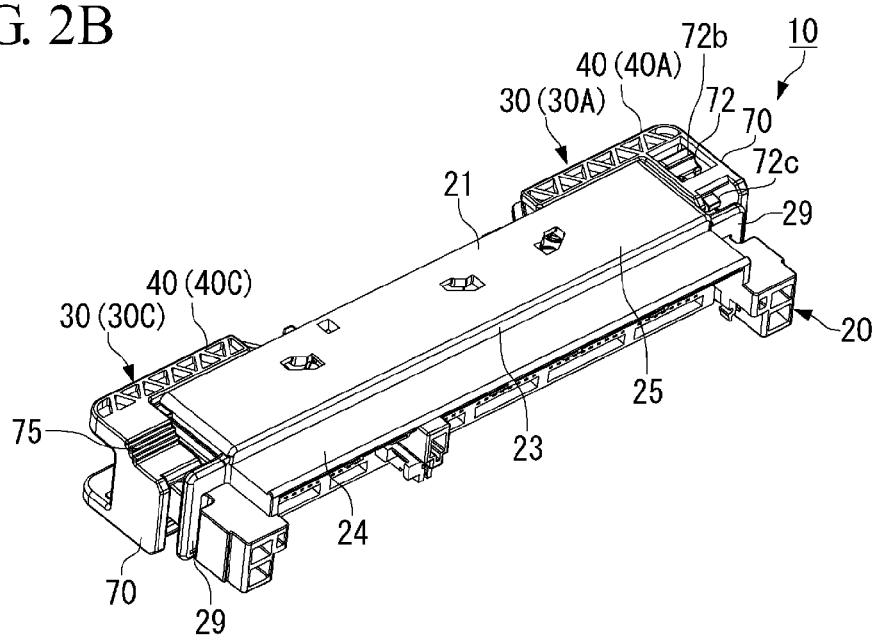
FIG. 2B is a perspective view of the electrical connector assembly as viewed from the receptacle side.

As shown in FIGS. 2A and 2B, levers 40A, 40C have a length extending toward the outside of the hood 26A, 26C when the lever 40A, 40C is when inserted. Each lever 40A, 40C is locked to the first housing 21 by a lock 70 on the outside of the hood 26A, 26C.

On the other hand, for the plug 30B connected to the hood 26B located between the hoods 26A and 26C, a lever 40B is locked to the first housing 21 on the inside of the hood 26B when mated.

As shown in FIGS. 4 A-D, the lever 40A, 40C is rotatably connected at the end 40*a* to a support shaft 41 on the side of the second housing 31. As shown in FIG. 1B, the support shaft 41 is offset to the side such as to be close to the hood 26B in the center when the plug housing 31 is mated with the hood 26A, 26C.

The lever 40A, 40C is formed so as to extend in the longitudinal direction when it is urged into the locked position.

As shown in FIGS. 4 A-D, in the levers 40A and 40C, a portion extending along a side surface 31*a* on both sides of the plug housing 31 is formed by a plate 46. The side surface 31*a* on both sides of the plug housing 31 is a portion facing the outer peripheral wall 25*a* continuing in the longitudinal direction. To reinforce the plate 46, a truss-structured reinforcing beam 47 is integrally formed in the upper end portion of the plate 46.

Also, in the plate 46, a concave part 48 for avoiding the interference with the hood 26A, 26C is formed under the reinforcing beam 47. To reinforce the lock 70, the concave part 48 is formed with a reinforcing rib 49 extending downward from the reinforcing beam 47. The reinforcing rib 49 is formed so as to extend to a position interfering with the hood 26A, 26C. The hood 26A, 26C is therefore formed with a slit (not shown) so that the reinforcing rib 49 can pass through it.

In the plate 46, a cam protrusion 55 is formed to project at a position projecting to the one end 40*a* of the lever 40A, 40C from the support shaft 41 to transmit the operating force of the lever 40A, 40C to the first housing 21 when the lever 40A, 40C is turned.

On the other hand, as shown in FIG. 1, in the outer peripheral wall 25*a* of the first housing 21, a cam groove 56 for guiding the cam protrusion 55 is formed. This cam groove 56 is formed from the upper end portion of the outer peripheral wall 25*a*, so that the cam protrusion 55 moves along the cam groove 56 when the lever 40A, 40C is rotated. At this time, as shown in FIG. 3, when the second housing 31 is inserted into the hood 26A, 26C of the first housing 21 with the lever 40A, 40C raised, the cam protrusion 55 enters the cam groove 56. As the other end 40*b* of the lever 40A, 40C is urged, the cam protrusion 55 is displaced along the cam groove 56. The operating force applied to the other end 40*b* of the lever 40A, 40C acts between the cam protrusion 55 and the cam groove 56 with leverage, and thereby the second housing 31 is inserted into or pulled out of the first housing 21. The cam groove 56 may be formed in a selected shape appropriate for exerting the multiplying force for inserting or pulling out the second housing 31 to or from the first housing 21.

Figures 4A, 4B, 4C, 4D:
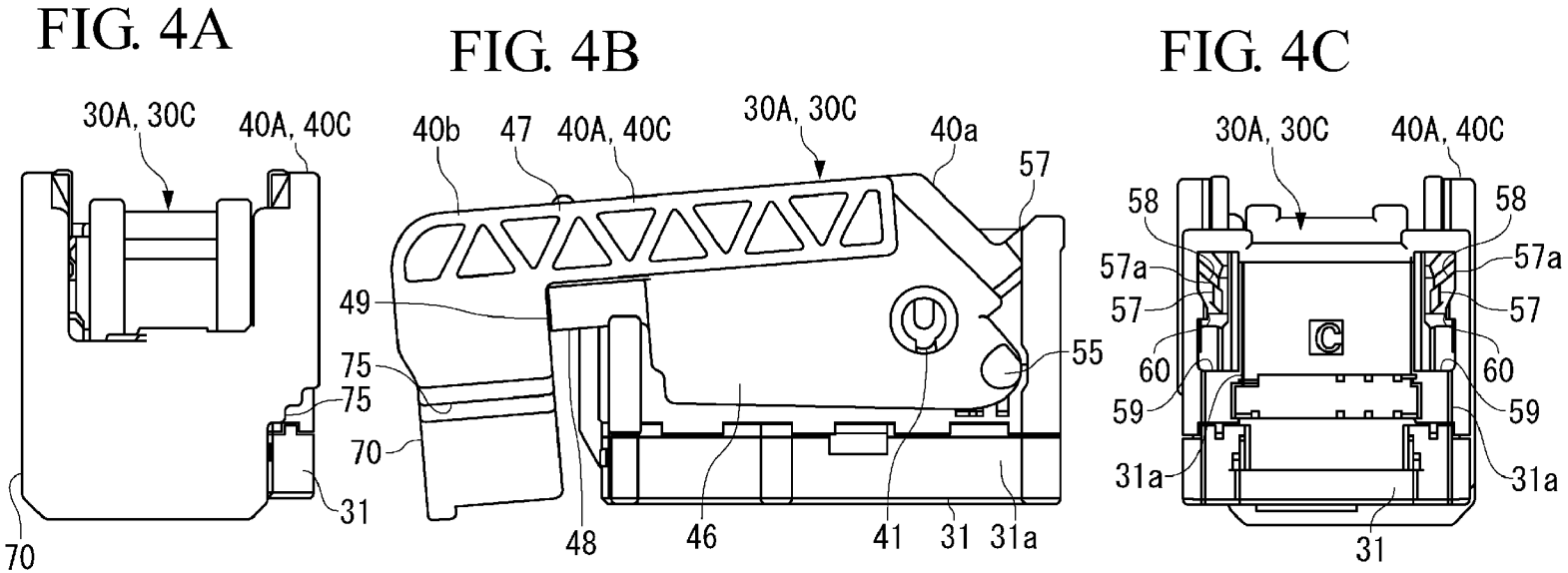
FIG. 4A is a left-hand side view of a plug.
FIG. 4B is a front view of the plug.
FIG. 4C is a right-hand side view of the plug.
FIG. 4D is a bottom plan view of the plug.

Also, as shown in FIG. 4B, in the tip end portion of the plate 46, a stopper 57 is formed at a position projecting from the support shaft 41 toward one end 40*a* of the lever 40A, 40C.

As shown in FIG. 4C, the second housing 31 is formed with a slit 58 into which the stopper 57 moves. The slit 58 is formed with a stop 59 with which the stopper 57 comes into contact to restrict further movement of the lever 40A, 40C when the lever 40A, 40C is raised. Also, the slit 58 is formed with a stopper claw 60 engaging with a claw 57*a* formed in the stopper 57. By engaging the stopper claw 60 with the claw 57*a*, the lever 40A, 40C can be held in position. When the lever 40A, 40C is urged from that position, the claw 57*a* move across the stopper claw 60.

As shown in FIG. 1, the other end 40*b* of the lever 40A, 40C extends in the longitudinal direction and is provided with the lock 70 extending on the outside of the hood 26A, 26C. Thus, the lever 40A, 40C locked to the first housing 21 by the locking part 70 is configured so as to cross over the hood 26A, 26C.

Figure 5:
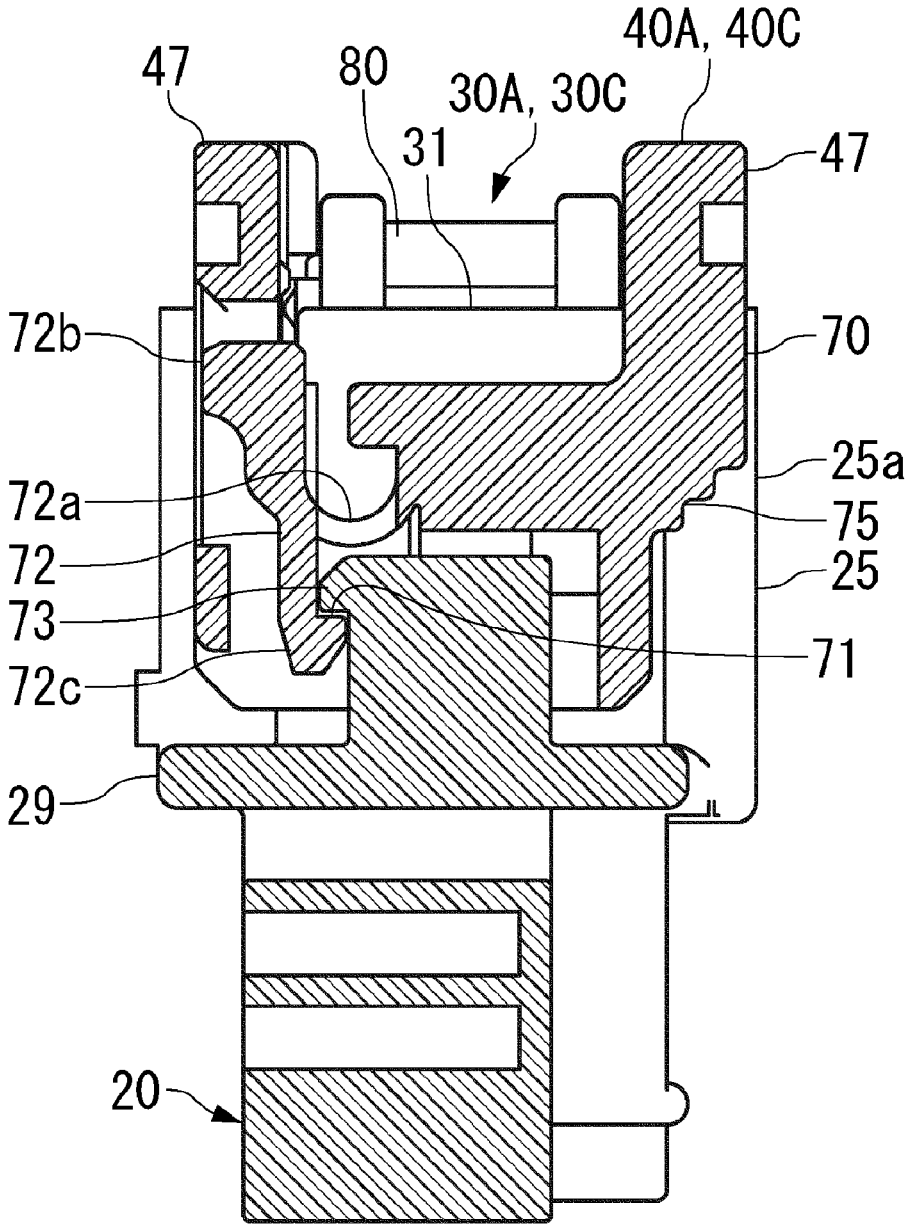
FIG. 5 is a sectional view of a locking part in a state in which a plug connector is mated with a receptacle connector.

As shown in FIG. 5, the locking part 70 is provided with a deformed piece 72 having a locking claw 71 locked to the first housing 21. In the lock 70, the deformed piece 72 is formed so as to face one side. That is, the deformed piece 72 is provided along a plane continuous with the outer peripheral wall 25*a* in a projection 29. The deformed piece 72 is provided integrally with the lever 40A, 40C in such a manner that a middle portion thereof is connected to the lever 40A, 40C via an elastic support 72*a*. When the upper end 72*b* is urged, by the elastic deformation of the elastic support 72*a*, the lower end 72*c* is displaced in the direction intersecting at right angles with the outer peripheral wall 25*a*. The locking claw 71 is formed on the side facing the inside of the plug connector 30 in the lower end 72*c* of the deformed piece 72, and is displaced in the above-described direction by the deformation and displacement of the deformed piece 72.

On the other hand, the projection 29 of the first housing 21 is provided with a locked protrusion 73 to which the locking claw 71 is locked. By locking the locking claw 71 to the locked protrusion 73, the lever 40A, 40C is locked to the first housing 21.

Also, in the lever 40A, 40C, a concave part 75 is formed in a lower portion of the surface on the side opposite to the side on which the deformed piece 72 is provided. When the lever 40A, 40C is raised, a finger or a tool can be placed on this concave part 75.

Also, as shown in FIG. 3, on the second housing 31, a protrusion 80 is provided on a side surface 31*b* facing the locking part 70 of the lever 40A, 40C. The protrusion 80 prevents the wires from being caught between the side surface 31*b* of the plug housing 31 and the locking part 70 of the lever 40A, 40C.

The protrusion 80 is formed so as to extend from an upper end portion of the side surface 31*b* obliquely upward on the lock 70 side. By this protrusion 80, a gap between the side surface 31*b* of the second housing 31 and the lock 70 of the lever 40A, 40C is closed in the upper end portion of the side surface 31*b* of the plug housing 31.

By fitting the three plugs 30A, 30B and 30C in the receptacle 20 so as to be arranged in one direction as described above, the plugs 30A, 30B and 30C each can be downsized.

For the plug 30B connected to the hood 26B located between the hoods 26A and 26C, the lever 40B is locked to the first housing 21 on the inside of the hood 26B. In contrast, for the plugs 30A and 30C connected to the hood 26A and 26C, respectively, on both end sides, the lever 40A, 40C has a length such as to project toward the outside of the hood 26A, 26C, and is locked to the first housing 21 on the outside of the hood 26A, 26C. Thereby, for the plugs 30A and 30C connected to the hood 26A and 26C, respectively, on both end sides, the second housing 31 is downsized, and nevertheless the length of the lever 40A, 40C cannot be so short. As a result, while the second housing 31 is downsized, the second housing 31 can be inserted into or pulled out of the first housing 21 easily and reliably by rotating the lever 40A, 40C with a smaller operating force.

Also, since the lever 40A, 40C has a configuration such as to be locked to the first housing 21 on the outside of the hood 26A, 26C, only the second housing 31 is inserted into the hood 26A, 26C. Therefore, even in the case where the second housing 31 is going to be inserted into the hood 26A, 26C in a fumbling manner, the inserting work can be performed easily and reliably without a shift of the plug housing 31 in the hood 26A, 26C.

The deformed piece 72 of the lock 70 is formed so as to face one side. Thereby, by deforming the deformed piece 72 so that the lock 70 is caught in the short side, the locking to the first housing 21 in the lock 70 can be released. Therefore, even in the case where the electric wires electrically connected to the contacts held in the second housing 31 intersect at right angles with the direction in which the second housing 31 is inserted into or pulled out of the first housing 21, and extend in the direction in which the lever 40A, 40C extends, the operator can operate the deformed piece 72 easily and reliably without being affected by the installation direction of electric wires. As a result, the locking to the first housing 21 using the lever 40A, 40C can be released.

On the second housing 31, the protrusion 80 is provided in the gap between the side 31*b* and the lock 70. By this protrusion 80, the gap between the side surface 31*b* of the second housing 31 and the lock 70 can be closed in the upper end portion of the side 31*b*. Therefore, the wires are prevented from being caught in this gap.

In the levers 40A and 40C, the concave part 75 is formed in the lower portion of the surface on the side opposite to the side on which the deformed piece 72 is provided. When the lever 40A, 40C is raised, a finger or a tool can be put on this concave part 75, so that the lever 40A, 40C can be raised reliably.

The configuration shown in the above-described embodiment is merely an example, and the specific configuration and the like can be changed to ones other than those shown in the above-described embodiment.

In the above-described embodiment, the lock 70 is configured so as to have the deformed piece 72 having the locking claw 71. However, the configuration of the lock 70 is not limited to the lock 70 configured so as to have the deformed piece 72 having the locking claw 71. The lock 70 can employ any other locking method as appropriate.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector assembly comprising:

a first housing comprising a hood forming a space;

a second housing mating with the first housing in the hood space and having a rotatable lever being rotatable about a support shaft to reduce a force for inserting the second housing into the hood;

the lever extending in a longitudinal direction, and formed so as to extend to an outside of the hood upon mating; and a lock for locking the lever to the first housing at substantially right angles with a direction in which the second housing is inserted into or pulled out of the first housing.

2. The electrical connector assembly according to claim 1, wherein the lock comprises, at a position facing a short side direction of the second housing, a deformed piece deformable along the short side direction of the second housing, and a locking claw formed on the deformed piece and locked to the second housing.

3. The electrical connector assembly according to claim 1, wherein an electric wire electrically connected to the second contact held in the second housing is installed in a direction in which the lever extends.

4. The electrical connector assembly according to claim 1, wherein either one of the second housing and the lever is provided with a protrusion formed so as to extend between the second housing and the lever.

5. The electrical connector assembly according to claim 1, wherein a concave part is formed in the other end portion of the lever.

* * * * *